US007160848B2

(12) United States Patent
Macnab et al.

(10) Patent No.: US 7,160,848 B2
(45) Date of Patent: Jan. 9, 2007

(54) POLYMERS AND LAUNDRY DETERGENT COMPOSITIONS CONTAINING THEM

(75) Inventors: Donna Macnab, Bebington (GB); Catherine Marie-Joseph Soret, Oxford (GB); Robert Kemeys Thomas, Oxford (GB); Albert van der Wal, Bebington (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 404 days.

(21) Appl. No.: 10/734,756

(22) Filed: Dec. 11, 2003

(65) Prior Publication Data

US 2004/0127390 A1 Jul. 1, 2004

(30) Foreign Application Priority Data

Dec. 13, 2002 (GB) ..... 0229146.6

(51) Int. Cl.
*C11D 1/12* (2006.01)
*C11D 3/37* (2006.01)
*D06L 1/00* (2006.01)

(52) U.S. Cl. ..... 510/475; 510/299; 510/351; 510/360; 510/426; 8/137

(58) Field of Classification Search ..... 510/299, 510/351, 360, 426, 475; 8/137
See application file for complete search history.

(56) References Cited

U.S. PATENT DOCUMENTS

| | | | | |
|---|---|---|---|---|
| 3,557,039 A | | 1/1971 | McIntyre et al. | 260/29.2 |
| 4,444,561 A | * | 4/1984 | Denzinger et al. | 8/137 |
| 4,846,994 A | | 7/1989 | Kud et al. | 252/174.21 |
| 4,904,408 A | * | 2/1990 | Kud et al. | 510/360 |
| 5,783,616 A | | 7/1998 | Krause et al. | 524/58 |
| 6,075,107 A | | 6/2000 | Kothrade et al. | 526/264 |

FOREIGN PATENT DOCUMENTS

| | | | |
|---|---|---|---|
| DE | 2 165 898 | | 7/1973 |
| DE | 21 65 834 | | 7/1973 |
| DE | 32 06 883 | | 9/1983 |
| DE | 37 11 229 | | 10/1988 |
| EP | 001 305 | | 4/1979 |
| EP | 262 945 | | 4/1988 |
| EP | 403 062 | | 12/1990 |
| EP | 271 312 | | 5/1996 |
| EP | 786 517 | | 7/1997 |
| EP | 786517 | * | 7/1997 |
| EP | 876 819 | | 11/1998 |
| EP | 957 156 | | 11/1999 |
| EP | 874 892 | | 4/2000 |
| EP | 1 019 476 | | 2/2003 |
| GB | 1 354 498 | | 5/1974 |
| GB | 1 467 098 | | 3/1977 |
| GB | 1 536 136 | | 12/1978 |
| GB | 2 043 082 | | 10/1980 |
| GB | 2043082 | * | 10/1980 |
| GB | 1 602 420 | | 11/1981 |
| WO | 91/00302 | | 1/1991 |
| WO | 92/18597 | | 10/1992 |
| WO | 94/03567 | | 2/1994 |
| WO | 94/06354 | | 3/1994 |
| WO | 94/24249 | | 10/1994 |
| WO | 95/03390 | | 2/1995 |
| WO | 95/17496 | | 6/1995 |
| WO | 95/27028 | | 10/1995 |
| WO | 95/34627 | | 12/1995 |
| WO | 97/03166 | | 1/1997 |
| WO | 97/20021 | | 6/1997 |
| WO | 97/42285 | | 11/1997 |
| WO | 99/09359 | | 2/1999 |
| WO | 03/044146 | | 5/2003 |

OTHER PUBLICATIONS

Derwent Abstract of WO 94/24249—Oct. 27, 1994.
Derwent Abstract of WO 97/03166—Jan. 30, 1997.
Derwent Abstract of DE 2 165 898—Dec. 31, 1971.
GB Search Report in a GB application GB 0229146.6.
GB Search Report in a GB application GB 0229147.4.
Derwent Abstract of WO 99/09359—Feb. 25, 1999.
Co-pending U.S. Appl. No. 10/735,376, filed Dec. 11, 2003, Claesson et al.
PCT International Search Report in a PCT application PCT/EP 03/12823.
PCT International Search Report in a PCT application PCT/EP 03/12797.
Derwent Abstract of WO 99/09359—published Feb. 25, 1999.

* cited by examiner

*Primary Examiner*—Brian P. Mruk
(74) *Attorney, Agent, or Firm*—Rimma Mitelman

(57) ABSTRACT

Hydrophobically modified vinyl pyrrolidone polymers which are copolymers having a vinyl pyrrolidone backbone and pendant hydrophobic side chains are useful in laundry detergent compositions to improve detergency and/or antiredeposition. The pendant hydrophobic side chains preferably comprise alkyl chains containing from 4 to 20 carbon atoms and may be linked to the backbone via an ester linkage.

13 Claims, No Drawings

POLYMERS AND LAUNDRY DETERGENT COMPOSITIONS CONTAINING THEM

TECHNICAL FIELD

The present invention relates to laundry detergent compositions containing certain vinyl pyrrolidone copolymers. The compositions exhibit improved detergency on oily and clay soils and reduced soil redeposition during the wash.

BACKGROUND AND PRIOR ART

Polyvinyl pyrrolidone (PVP) and some related polymers are known ingredients of laundry detergent compositions, providing the benefit of reduced dye transfer between fabrics in a mixed load.

Laundry detergent compositions containing PVP as a dye transfer inhibitor are disclosed, for example, in WO 92 18597A and WO 95 27028A (Procter & Gamble).

GB 1 354 498 (Unilever) discloses laundry detergent compositions containing vinyl pyrrolidone/vinyl acetate (PVP/VA) random copolymers as antiredeposition agents. PVP itself is stated to be ineffective.

Other vinyl pyrrolidone copolymers are known for cosmetic and agricultural applications.

Definition of the Invention

In a first aspect, the present invention provides a laundry detergent composition comprising an organic surfactant, and a hydrophobically modified vinyl pyrrolidone polymer which is a copolymer having a vinyl pyrrolidone backbone and pendant hydrophobic side chains comprising alkyl chains containing from 4 to 20 carbon atoms, the polymer being present in an amount effective to improve detergency and/or antiredeposition.

In a second aspect, the invention provides the use of a hydrophobically modified vinyl pyrrolidone polymer to improve the detergency and/or antiredeposition of a laundry detergent composition.

The Hydrophobically Modified Vinyl Pyrrolidone Polymer

The polymer used in the detergent compositions of the invention is a polyvinyl pyrrolidone modified by the inclusion of hydrophobic units as pendant side chains. The polymer is a copolymer of vinyl pyrrolidone (VP), providing the polymer backbone, and a hydrophobic monomer.

Vinyl pyrrolidone has the formula

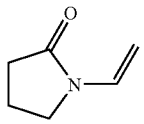

The hydrophobic side chains preferably comprise alkyl chains containing from 4 to 20 carbon atoms.

First Preferred Embodiment

According to a first preferred embodiment of the invention, the polymer is an alkylated vinyl pyrrolidone polymer wherein the alkyl chains contain from 4 to 20 carbon atoms.

In this embodiment of the invention, the hydrophobic side chains are derived from a hydrophobic comonomer which is an olefin containing from 4 to 20 carbon atoms.

Preferably the polymer contains from 10 to 90 mole % of vinyl pyrrolidone (VP) units and from 10 to 90 mole % of hydrophobic comonomer units.

Suitable polymers are commercially available from International Specialty Products (ISP) as the Ganex (Trade Mark), Antaron (Trade Mark) and Agrimer (Trade Mark) series. They may be prepared by chemical modification of PVP with long-chain alpha-olefins. Examples are shown in the Table below.

| Polymer trade name | Alkyl chain | Comonomer (olefin) | Mole ratio VP:olefin | Physical form |
|---|---|---|---|---|
| Agrimer AL-10<br>Ganex P904LC<br>Antaron P904 | $C_4$ | Butene | 90:10 | Water-soluble powder |
| Ganex V216<br>Antaron V216 | $C_{16}$ | Hexadecene | 20:80 | Water-insoluble wax |
| Ganex V516<br>Antaron V516 | $C_{16}$ | Hexadecene | 50:50 | Water-insoluble wax |

These polymers are marketed for use in cosmetic and personal care compositions, and for agricultural purposes as ingredients in crop treatment compositions.

Second Preferred Embodiment

According to a second preferred embodiment of the invention, the hydrophobically modified vinyl pyrrolidone polymer has pendant hydrophobic side chains which are alkyl chains having from 4 to 20 carbon atoms linked to the vinyl pyrrolidone backbone by an ester linkage.

The hydrophobic monomer precursor of the side chains is preferably a vinyl ester of the general formula I:

$$R^1—CO—O—CH{=}CH_2 \qquad (I)$$

wherein $R^1$ is a linear or branched alkyl group having from 4 to 16 carbon atoms.

In the general formula I, $R^1$ is preferably a linear or branched alkyl group having from 6 to 10 carbon atoms.

More preferably, $R^1$ is a group of the formula II

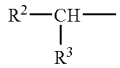

(II)

wherein $R^2$ is a linear alkyl group having from 2 to 8 carbon atoms and $R^3$ is a methyl or ethyl group.

Most preferably, the hydrophobic comonomer of the formula I is vinyl 2-ethylhexanoate:

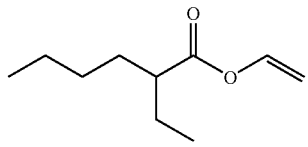

The polymer preferably contains from 90 to 99.5 wt % of vinyl pyrrolidone monomer units and from 0.5 to 10 wt % of vinyl 2-ethyl hexanoate monomer units.

Copolymers of vinyl pyrrolidone and vinyl 2-ethylhexanoate have the general formula III

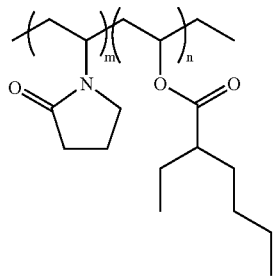

Preparation of the Polymers having an Ester Linkage

These polymers may be prepared by free radical polymerisation.

A process suitable for preparing these polymers is disclosed in U.S. Pat. No. 5,319,041 (Zhong et al) which describes the synthesis of copolymers of vinylpyrrolidone and vinyl acetate. An alternative process is disclosed in U.S. Pat. No. 5,122,582 (Porthoff-Karl).

The Laundry Detergent Composition

In the detergent composition of the invention, the polymer is present in an amount sufficient to enhance detergency and/or antiredeposition. Suitably the polymer is present in an amount of from from 0.5 to 5 wt %, preferably from 1 to 4 wt %.

The detergent composition may suitably comprise:

(a) from 5 to 60 wt %, preferably from 10 to 40 wt %, of organic surfactant, (b) optionally from 5 to 80 wt %, preferably from 10 to 60 wt %, of detergency builder, (c) from 0.5 to 5 wt %, preferably from 1 to 4 wt %, of the hydrophobically modified vinyl pyrrolidone polymer, (d) optionally other detergent ingredients to 100 wt %.

The pH of the detergent composition is suitably in the range of from 7.0 to 11.0, preferably 7.5 to 10.5. During the wash in dilute form the pH of the detergent composition is from 7 to 11, preferably from 8.0 to 10.5.

The Organic Surfactant

The compositions of the invention may contain any organic surfactants (detergent-active compounds) suitable for incorporation into laundry detergent compositions.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 60 wt %, preferably from 5 to 40 wt %.

Anionic surfactants are well-known to those skilled in the art. Examples include alkylbenzene sulphonates, particularly linear alkylbenzene sulphonaites having an alkyl chain length of $C_8$–$C_{15}$; primary and secondary alkylsulphates, particularly $C_8$–$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

According to a preferred embodiment of the invention, the composition comprises a sulphonate anionic surfactant. According to an especially preferred embodiment, the sulphonate anionic surfactant comprises linear alkylbenzene sulphonate (LAS).

An especially favourable interaction between LAS and the hydrophobically modified vinyl pyrrolidone polymer has been observed, giving improved primary detergency on difficult oily and particulate soils such as dirty motor oil and mud, and reduced redeposition of soil onto the washload during the wash (sometimes referred to as secondary detergency). Without being bound by theory, it is postulated that the this benefit may be attributed to a reduction in the critical micelle concentration (CMC) of the LAS. Preferably, the compositions contains from 3 to 30 wt %, more preferably from 10 to 25 wt %, of LAS.

The Optional Detergency Builder

Preferably, the detergent compositions of the invention also contain one or more detergency builders. The total amount of detergency builder in the compositions may suitably range from 5 to 80 wt %, preferably from 10 to 60 wt %.

Preferred builders are alkali metal aluminosilicates, more especially crystalline alkali metal aluminosilicates (zeolites), preferably in sodium salt form.

Zeolite builders may suitably be present in a total amount of from 5 to 60 wt %, preferably from 10 to 50 wt %.

The zeolites may be supplemented by other inorganic builders, for example, amorphous aluminosilicates, or layered silicates such as SKS-6 ex Clariant.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Alternatively, the compositions of the invention may contain phosphate builders, for example, sodium tripolyphosphate.

Especially preferred organic builders are citrates, suitably used in amounts of from 1 to 30 wt %, preferably from 2 to 15 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

According to a preferred embodiment of the invention, the detergency builder, which is present in an amount of from 5 to 80 wt %, preferably from 10 to 60 wt %, is selected from sodium tripolyphosphate, zeolites, sodium carbonate and mixtures thereof.

Other Detergent Ingredients

Detergent compositions according to the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

As previously indicated, sodium silicate may also be present. The amount of sodium silicate may suitably range from 0.1 to 5 wt %. Sodium silicate, as previously indicated, is preferably introduced via the second base granule.

Powder flow may be improved by the incorporation of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; coloured speckles; perfumes; and fabric conditioning compounds. This list is not intended to be exhaustive.

Product Form and Preparation

The compositions of the invention may be of any suitable physical form, for example, particulates (powders, granules, tablets), liquids, pastes, gels or bars.

According to one especially preferred embodiment of the invention, the detergent composition is in particulate form.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

Also preferred are liquid detergent compositions, which may be prepared by admixing the essential and optional ingredients in any desired order to provide compositions containing the ingredients in the requisite concentrations.

Incorporation of the Hydrophobically Modified Vinyl Pyrrolidone Polymer

The polymers may be incorporated at any suitable stage in the manufacture of the compositions of the invention.

For example, in the manufacture of spray-dried particulate compositions, polymer in powder or solution (preferably aqueous) form may be incorporated in the slurry. For non-tower particulates, polymer powder or solution may be easily introduced into mixing and granulating apparatus, either alone or in admixture with other solid or liquid ingredients as appropriate.

EXAMPLES

The invention is further illustrated by the following Examples, in which parts and percentages are by weight unless otherwise stated.

Examples 1 to 4

Preparation of vinyl pyrrolidone/vinyl 2-ethylhexanoate Copolymers

The following copolymers were prepared by free radical polymerisation. The preparation was adapted from the process described in U.S. Pat. No. 5,319,041 (Zhong et al).

| Example | Weight % vinyl pyrrolidone | Weight % vinyl 2-ethyl hexanoate |
|---|---|---|
| 1 | 99 | 1 |
| 2 | 98 | 2 |
| 3 | 96 | 4 |
| 4 | 92 | 8 |

The starting materials used were as follows (* denotes Trade Mark):

| Name | Chemical name | Supplier | Function |
|---|---|---|---|
| VP | Vinylpyrrolidone | Aldrich | Monomer |
| V2EH | Vinyl 2-ethylhexanoate | Aldrich | Monomer |
| Vazo* 67 | 2,2-azobis(2-methylbutyronitrile) | Fluka | Initiator |
| Luperox* 101 | 2.5-bis(tert-butylperoxy)-2.5-dimethylhexane | Aldrich | Initiator |
| Butanol | n-Butanol | | Solvent |

Experimental Procedure

The polymers were prepared using a four-step procedure as described below.

The relative weights of VP and V2EH required were calculated in function of the % of hydrophobic units needed in the final copolymer. For example, the total quantities required to make a 200 g batch of the polymer of Example 1 as follows:

| Addition Step/Reagent | VP (g) | V2EH (g) | VAZO*67 (g) | Luperox*101 (g) | Butanol (g) |
|---|---|---|---|---|---|
| 1 | 19.8 | 0.25 | 0.0312 | 0.0312 | 20.05 |
| 2 | — | — | 0.2688 | 0.2688 | 2 |
| 3 | 59.4 | 0.75 | — | — | 60.15 |
| 4 | 19.8 | — | — | — | 19.8 |
| Total amounts (g) | 99 | 1 | 0.3 | 0.3 | 102 |

Four-step Process

A first mixture was prepared to the following composition:

| | |
|---|---|
| VP | 20% of total weight of monomers |
| V2EH | 25% of total weight of monomers |
| Vazo* 67 | 10.4% of 0.3% of total weight of monomers (VP + V2EH) |
| Luperox* 101 | 10.4% of 0.3% of total weight of monomers (VP + V2EH) |
| Butanol | Amount equal to total weight of VP + V2EH in this mixture |

The monomers were charged under a blanket of nitrogen in a 125 mL four-neck flask equipped with a compressed air stirrer, reflux condenser and thermometer. The components were stirred for about 10 minutes and heated to 85° C.

Then a second mixture having the following composition:

| | |
|---|---|
| Vazo* 67 | 89.6% of 0.3% of total weight of monomers (VP + V2EH) |
| Luperox* 101 | 89.6% of 0.3% of total weight of monomers (VP + V2EH) |
| Butanol | 2 g |

was added over a period of 30 minutes.

A third mixture of having the following composition:

| | |
|---|---|
| VP | 60% of total weight of VP |
| V2EH | 75% of total weight of V2EH |
| Butanol | 100% of total weight of VP and V2EH of third mixture |

was then gradually added over a period of 40 minutes.

Upon completion of V2EH monomer addition, a fourth mixture having the following composition:

| | |
|---|---|
| VP | 20% of total weight of VP |
| Butanol | 100% of weight of VP of fourth mixture |

was added over a period of 15 min.

After the above additions were completed, the temperature was increased to 117° C. for 3 hours. The reactor contents were then cooled to room temperature.

The copolymers were characterised by means of proton NMR spectroscopy and gel permeation chromatography.

Example 5

Detergency/Antiredeposition Performance

Detergency and antiredeposition performance of the polymers were evaluated by a small scale wash method, using a laundry detergent composition having the following formulation:

| | Weight % |
|---|---|
| Linear alkylbenzene sulphonate | 6.00 |
| Sodium $C_{12}$–$C_{14}$ alcohol ethoxy sulphate 3EO | 10.50 |
| Nonionic surfactant ($C_{12}$–$C_{14}$ alcohol ethoxylate, 9EO) | 6.60 |
| Sodium citrate dihydrate | 3.20 |
| Propylene glycol | 4.75 |
| Sorbitol | 3.25 |
| Sodium borate pentahydrate | 2.13 |
| (Water to | 100.00) |

This formulation has a pH of 7.0. In the doseage 1 g/L and 2 g/L it has a pH of 8.8.

Methodology

The polymers were tested for their ability to enhance the removal of oily and clay/sebum soil from white cotton fabric, using an apparatus for simulating a soiling and wash procedure on a small scale.

Using this apparatus, the fabric was soiled, and subjected to a simulated main wash procedure using wash liquors with and without the polymer according to the invention.

The Apparatus

The wash apparatus used allows different liquids to be simultaneously contacted with different regions of a single sheet of fabric. The fabric sheet is clamped between an upper and lower block. The fabric sheet is sandwiched between two rubber seals. Both blocks and seals contain an 8×12 array of square cavities, which are aligned. When blocks and fabrics are clamped together, liquids placed in individual wells do not leak or bleed through to other wells, due to the pressure applied by the blocks in the regions separating the wells. The liquids are forced to flow back and forth through the fabric by means of a pneumatically actuated thin rubber membrane, which is placed between the fabrics and the lower block. Repeated flexing of the membrane away from and towards the fabrics results in fluid motion through the fabrics.

Soiling

For the oily soil evaluation, the dry fabric was placed on top of a 96 well polypropylene microtitre plate. Oily soil (5 μL of dirty motor oil (15% weight in toluene)) was dispensed from a pipette, onto the centre of each of the 96 cells on the cloth. The stained fabrics were allowed to dry at room temperature for 24 hours.

For clay/sebum soiling a standard cotton test cloth (AS9) was used.

Wash

The test fabric was then clamped in the washing apparatus, 200 μL doses of each wash solution were placed in appropriate wells. The liquids flowed through the fabrics for 20 minutes, at 30° C. with a flow cycle time of 1.5 seconds. After 20 minutes, the free liquid in the cells was poured off.

The blocks where then separated and the fabric removed, and thoroughly rinsed for 1 minute in 200 mL demineralised water. The fabrics were allowed to dry for 24 hours. Reflectance (ΔE or ΔR) was then measured.

Experimental Conditions

The experiments were carried out at product doses of 0.1, 0.5 and 1.5 g/L, in water of 3° and 12° FH, the hardness being made up of three parts calcium to 1 part magnesium. The polymers were dosed separately at levels of 0.05, 0.1 and 0.5 g/l, and there was also a polymer-free control for each set of conditions.

For the tests using oily soil (dirty motor oil), the results are expressed as SRI (soil release index), where SRI=100−ΔE For the tests using clay/sebum soil, the results are expressed as ΔR (image analysis, equivalent to ΔR at 460 nm).

Results for the Polymer of Example 4

Clay/Sebum Soil

| Product | Water | ΔR (460 nm) for polymer concentrations of | | |
|---|---|---|---|---|
| dose g/L | Hardness (° F.) | 0 (control) | 0.05 | 0.5 |
| 0.1 | 3 | 4.01 | 4.13 | 4.37 |
| 0.5 | 3 | 3.99 | 4.36 | 4.72 |
| 1.5 | 3 | 4.60 | 5.44 | 5.72 |
| 0.1 | 12 | 3.50 | 4.00 | 3.84 |
| 0.5 | 12 | 3.67 | 4.01 | 3.99 |
| 1.5 | 12 | 3.94 | 4.36 | 4.80 |

Oily Soil (Dirty Motor Oil)

| Product | Water | SRI for polymer concentrations of | | | |
|---|---|---|---|---|---|
| dose g/L | hardnesS (° F.) | 0 (control) | 0.05 | 0.1 | 0.5 |
| 0.1 | 3 | 71.31 | 71.82 | 71.78 | 71.92 |
| 0.5 | 3 | 72.20 | 72.58 | 72.21 | 72.36 |
| 1.5 | 3 | 72.99 | 74.01 | 73.17 | 73.59 |
| 0.1 | 12 | 71.16 | 71.49 | 71.13 | 71.88 |
| 0.5 | 12 | 71.94 | 72.66 | 72.14 | 72.15 |
| 1.5 | 12 | 73.10 | 74.49 | 73.59 | 74.19 |

Averaged Results for the Polymers of Examples 1–4

The following table shows the results for all four polymers on oily soil (dirty motor oil) averaged over all product levels (0.1, 0.5 and 1.5 g/l), polymer levels (0.05, 0.1 and 0.5 g/l), and water hardnesses (3 and 12° FH).

The results are expressed as reflectance increases (ΔR) compared with a control containing no polymer. All results represent a significant difference at 95%.

| Polymer of Example | Mean ΔR |
|---|---|
| 1 | 0.49 |
| 2 | 0.36 |
| 3 | 0.46 |
| 4 | 0.51 |

The invention claimed is:

1. A laundry detergent composition comprising an organic surfactant comprising from 3 to 30% of linear alkylbenzene sulphonate, and a hydrophobically modified vinyl pyrrolidone polymer which is a copolymer having a vinyl pyrrolidone backbone and pendant hydrophobic side chains wherein the pendant hydrophobic side chains of the copolymer are derived from a vinyl ester of the general formula I:

$$R^1—CO—O—CH{=}CH_2 \quad (I)$$

wherein $R^1$ is a linear or branched alkyl group having from 6 to 10 carbon atoms, the polymer being present in an amount effective to improve detergency and/or antiredeposition.

2. A detergent composition as claimed in claim 1, wherein the polymer contains from 10 to 90 mole % of vinyl pyrrolidone units and from 10 to 90 mole % of hydrophobic comonomer units.

3. A detergent composition as claimed in claim 1, wherein in the general formula I $R^1$ is a group of the formula II $$R^2—\underset{\underset{R^3}{|}}{CH}— \quad (II)$$

wherein $R^2$ is a linear alkyl group having from 2 to 8 carbon atoms and $R^3$ is a methyl or ethyl group.

4. A detergent composition as claimed in claim 1, wherein the polymer contains units derived from vinyl 2-ethylhexanoate.

5. A detergent composition as claimed in claim 1, wherein the polymer contains from 90 to 99.5 wt % of vinyl pyrrolidone monomer units and from 0.5 to 10 wt % of vinyl 2-ethylhexanoate monomer units.

6. A detergent composition as claimed in claim 1, which contains from 0.5 to 5 wt % of the hydrophobically modified vinyl pyrrolidone polymer.

7. A detergent composition as claimed in claim 1, which comprises:

(a) from 5 to 60 wt % of organic surfactant, (b) optionally from 5 to 80 wt %, of detergency builder, (c) from 0.5 to 5 wt % of the hydrophobically modified vinyl pyrrolidone polymer, (d) optionally other detergent ingredients to 100 wt %.

8. A detergent composition as claimed in claim 1 with a pH of from 7.0 to 11.0.

9. A detergent composition as claimed in claim 1, wherein contains from 10 to 25 wt %, of linear alkylbenzene sulphonate.

10. A detergent composition as claimed in claim 1, which comprises from 5 to 80 wt % of detergency builder selected from the group consisting of sodium tripolyphosphate, zeolites, sodium carbonate and mixtures thereof.

11. A method of improving the detergency and/or antiredeposition of a laundry detergent composition, the method comprising incorporating the laundry detergent composition of claim 1 into the composition.

12. A detergent composition is claimed in claim 6 which contains from 1 to 4 wt % of the hydrophobicaily modified vinyl pyrrolidone polymer.

13. Additives and composition as claimed in claim 1 with a pH from 7.5 to 10.5.

* * * * *